United States Patent [19]

Valle et al.

[11] Patent Number: 4,589,784

[45] Date of Patent: May 20, 1986

[54] POINT OF SALE PRINTER

[75] Inventors: Franco Valle, Ivrea; Sergio Sofi, Turin, both of Italy

[73] Assignee: Ing. C. Olivetti & C., S.p.A., Ivrea, Italy

[21] Appl. No.: 569,857

[22] Filed: Jan. 11, 1984

[30] Foreign Application Priority Data

Jan. 11, 1983 [IT] Italy ..... 67018 A/83

[51] Int. Cl.[4] ..... B41J 11/20

[52] U.S. Cl. ..... 400/56; 400/584; 400/596

[58] Field of Search ..... 400/56, 59, 584, 585, 400/586, 588, 592, 593, 595, 596, 597, 604, 605, 609

[56] References Cited

U.S. PATENT DOCUMENTS

| | | | |
|---|---|---|---|
| 3,904,010 | 9/1975 | Krauss et al. | 400/56 |
| 3,978,964 | 9/1976 | Kwan | 400/584 X |
| 4,109,779 | 8/1978 | Bauer et al. | 400/584 |
| 4,229,113 | 10/1980 | Anderson et al. | 400/596 |
| 4,234,261 | 11/1980 | Hendrischk et al. | 400/596 X |
| 4,250,780 | 2/1981 | Shimizu et al. | 400/621 X |
| 4,268,177 | 5/1981 | Veale | 400/59 X |
| 4,367,964 | 1/1983 | Cranston | 400/597 X |

FOREIGN PATENT DOCUMENTS

| | | | |
|---|---|---|---|
| 1109333 | 9/1981 | Canada | 400/597 |
| 0101881 | 8/1981 | Japan | 400/584 |

*Primary Examiner*—Edgar S. Burr
*Assistant Examiner*—John A. Weresh
*Attorney, Agent, or Firm*—Banner, Birch, McKie & Beckett

[57] ABSTRACT

A print head (15) on a carriage (16) slides on a carriage guide bar (17) in front of a platen bar (18). A receipt slip (25) is fed from a roll (26) over part of the width of the platen bar (18) to a knife (40) for cutting off individual receipts. A daybook slip (45) is fed from a roll (46) over the bar (18) to a take-up roll (50). Other documents may be fed in for printing either downwardly between upper guides (37 and 38) or upwardly between lower guides (35 and 55). In either event the inserted document is engaged by a drive roller (60) and pressure roller (70) to be positioned at a predetermined height, under control of photodetectors (80 and 81). The pressure roller (70) is mounted between levers and can move away from the drive roller (60) to accommodate the thickness of the inserted document. The levers also support the carriage guide (17), whereby the head (15) is positioned a constant distance from the surface on which printing is effected.

3 Claims, 5 Drawing Figures

POINT OF SALE PRINTER

BACKGROUND OF THE INVENTION

The present invention relates to a point of sale printer, e.g. for cash registers, comprising a printing head, and means for selectively and individually feeding each of a receipt slip and a daybook slip from a corresponding supply roll to the printing head.

SUMMARY OF THE INVENTION

The object of the present invention is to provide a printer which is also capable of individually processing other recording carriers such as forms or cards, index cards and the like, of various formats, and without manually altering the setting of the printing head for the receipt and daybook slips.

In meeting this object, the printer according to the invention is characterised by guide means for guiding other recording carriers of various formats from below or from above to the printing head, by means for holding the printing head at a predetermined spacing from the recording carrier introduced and by optical means arranged to detect an edge of the recording carrier to position the same as a predetermined height from the print line.

The invention will be described in more detail, by way of example, with reference to the accompanying drawings.

DETAILED DESCRIPTION OF A PREFERRED EMBODIMENT

Figure 1:
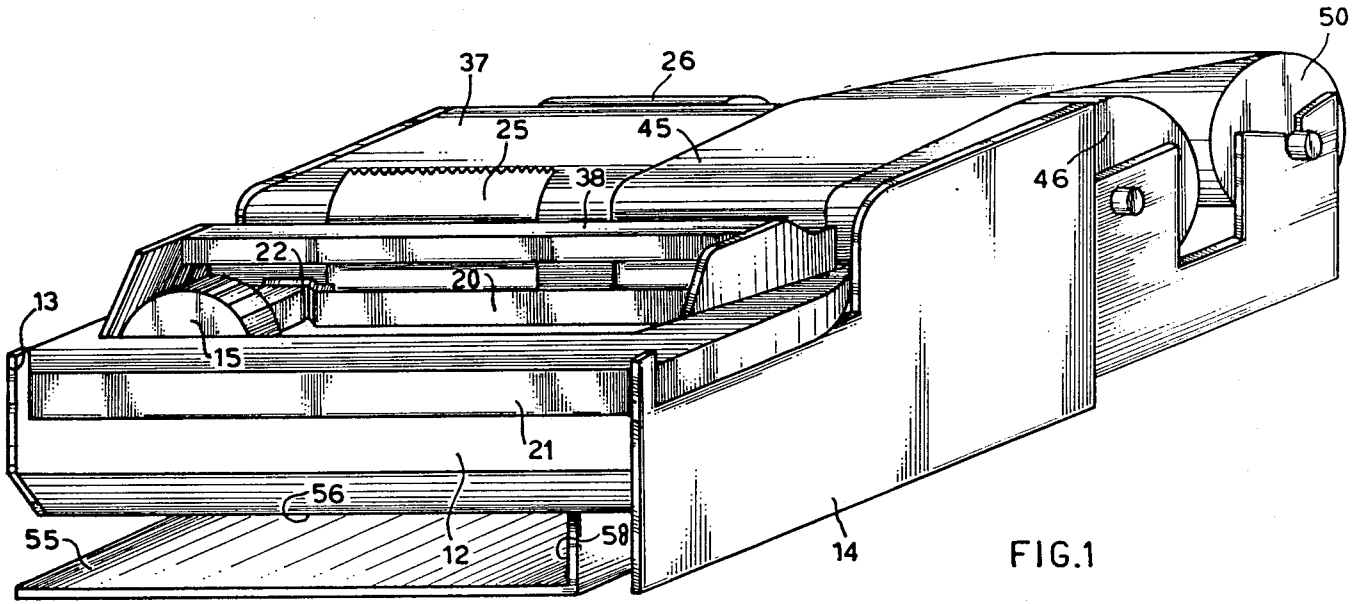
FIG. 1 is a perspective view of a point of sale printer embodying the invention.
Figure 2:
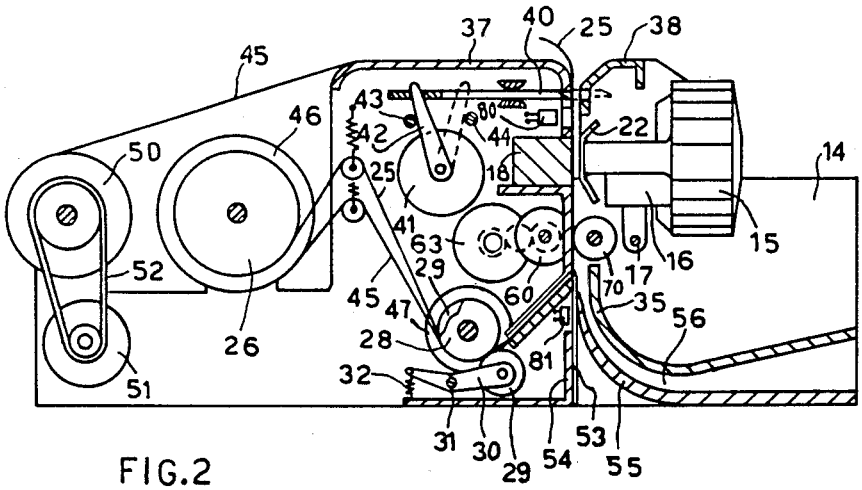
FIG. 2 is a side view of the left-hand side of the printer shown in FIG. 1, in partial section and on a reduced scale.

Referring to FIG. 1, a point of sale printer 10, e.g. for a cash register, comprises a frame or chassis structure 12 having two side panels 13 and 14 which are parallel to each other, and a needle printing head 15 which is known per se, for example of the type described in the U.S. patent application Ser. No. 541,316 filed on Oct. 12, 1983 and assigned to the same assignee of the present invention. The head 15 is mounted on a carriage 16 (see FIG. 2) which is movable, by means of an electric motor (not shown in the drawings) on a cylindrical guide 17 parallel to a platen bar 18 which is mounted between the side panels 13 and 14, perpendicular thereto. A printing ribbon 20 contained in a cartridge 21 is held in a tensioned condition between the head 15 and the bar 18, and a ribbon guide 22 prevents the ribbon 20 from rubbing on the bar 18 or on the item which is to be printed.

Figure 3:
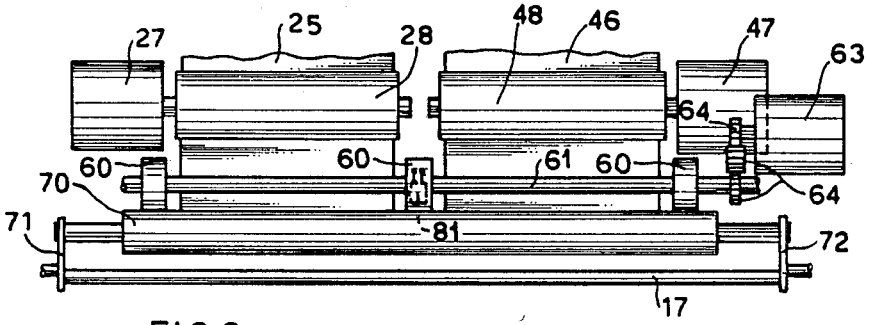
FIG. 3 is a view in section taken along line 3—3 in FIG. 2.

A paper receipt slip 25 which is wound on a supply roll 26 is fed to the printing head 15 by an electric motor 27 (see FIG. 3) of stepping type, which is connected to a rubber roller 28. The slip 25 is pressed against the roller 28 by a pressure roller 29 (see FIG. 2) mounted on a lever 30 pivoted on a pivot 31 and pulled by a spring 32. In the section between the rollers 28, 29 and the head 15, the slip 25 is guided by guides 33, 34 and 35 which are fixed to the chassis structure 12 while, after having passed between the head 15 and the bar 18, in the upper part of the path of movement thereof, the slip 25 is guided by guides 37 and 38 which are also fixed to the chassis structure 12.

The slip 25 can be selectively cut off by a metal blade or knife 40 which is at least as wide as the slip 25 and is actuated by a bidirectional d.c. electric motor 41, by means of a lever 42 which can oscillate between two fixed abutments 43 and 44.

A paper daybook slip 45 which is wound on a supply roll 46 coaxial with the roll 26 can be fed to the printing head 15 by an electric motor 47 (see FIG. 3) of stepping type, which is connected to a rubber roller 48. Another pressure roller 29 which is not shown in the drawings and which is also mounted on a lever pulled by a spring presses the slip 45 against the roller 48.

The slip 45, in its portion between the roller 48 and the head 15, is also guided by the guides 33, 34 and 35 while in the upper part of its path of movement, after having passed between the head 15 and the bar 18, it is guided by the guides 37 and 38.

Figure 5:
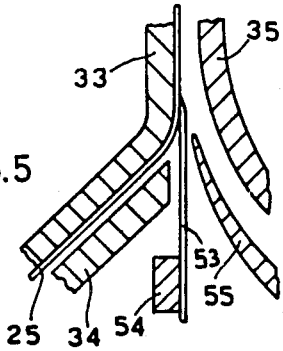

A blade spring 53 (see FIGS. 2 and 5) which is fixed to a cross member 54 of the chassis structure 12 is arranged to press the slips 25 and 45 against the guide 33, with a loading of a few grams. Unlike the receipt paper 25, the daybook slip 45 is rewound on a take-up roll 50 which is connected to an electric motor 51 of stepping type, by means of a belt 52.

The printer 10 is also provided with means which permit other recording carriers to be processed. In particular, a lower guide 55 defines, with the guide 35, a path 56 for introducing from below forms or cards, coupons or other recording carrier while, from above, such carriers may be inserted directly between the guides 37 and 38. In addition, carriers of various formats can be inserted in the printer since only the right-hand side (FIG. 1) of the path 56 is defined by a lateral shoulder 58, while the left-hand side is open.

The cards or forms which are inserted between the guides 35 and 55 from below or between the guides 37 and 38 from above are fed in and positioned with respect to the print line of the printing head 15 by a series of rubber rollers 60 (see FIG. 3) mounted on a shaft 61 rotatable in the chassis structure 12, the rotation being effected by an electric motor 63 of stepping type acting through gears 64.

Figure 4:
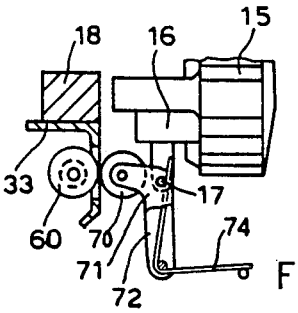
FIG. 4 is a side view from the left-hand side of a detail of the printer shown in FIG. 1 and, FIG. 5 is a detail on an enlarged scale from FIG. 2.

A metal roller 70 is mounted rotatably between two levers 71 and 72 which are pivoted on the chassis structure 12. Also mounted between the two levers 71 and 72 is the cylindrical guide 17 on which the carriage 16 is movable. A blade spring 74 (see FIG. 4) constantly urges the metal roller 70 towards the rubber rollers 60.

Two optical detectors 80 and 81 (see FIG. 2) of the reflection type are disposed one above the bar 18 and the other below the guide 34 to detect an edge of the form or card which may be inserted into the printer from above or from below respectively. In order not to interfere with the path of movement of the slips 25 and 45, the optical detectors 80 and 81 are disposed in alignment with the central roller 60 (see FIG. 3). The mode of operation of the printer described hereinbefore is as follows:

The receipt and daybook slips 25 and 45 respectively are fed by the respective motors 27 and 47 to the printing head 15. After the data have been printed on the two slips, they are advanced upwardly and, while the daybook slip is rewound by the motor 51 on the collection roll 50, the receipt slip is cut off by the blade 40 which is actuated by the motor 41. The head 15 is at a predetermined spacing from the slips 25 and 40, with the roller 70 being against the rubber roller 60. When a form or card is introduced from below, between the guides 35 and 55, the upper edge thereof is detected by the optical detector 81, which, actuating the motor 63, causes the rollers 60 and 70 to rotate. The inserted form or card moves upwardly, entrained by the rollers 60 and 70, say until its upper edge is detected by the detector 80, which stops the motor 63 and thus positions the form or card at a certain height from the print line of the printing head 15.

The form or card has thus moved upwardly into a position between the rollers 60 and 70 and the latter has been moved away from the former. The head 15 which is mounted on the carriage 16 is therefore also moved away from the bar 18, always being maintained at the same spacing from the form or card which is to be printed upon.

If the form or card is introduced from above, between the guides 37 and 38, it is the detector 80 which detects the lower edge of the form or card and sets the motor 63 in operation in the opposite direction to the previous direction. The rollers 60 and 70 thus causes the form or card to be moved downwardly, e.g. until the same optical detector 80 ceases to detect the upper edge thereof. The motor 63 is then switched off and in that case also the upper edge will be positioned at a predetermined distance from the print line of the printing head 15.

We claim:

1. A point of sale printer comprising:

a frame;

a platen fixedly mounted on said frame;

a printing head disposed in front of said platen;

a carriage on which said printing head is mounted;

a guide bar for guiding said carriage and the printing head mounted thereon parallel to said platen along a rectilinear printing path which comprises a first printing zone and a second printing zone adjacent therebetween;

a first motor roller for feeding a first continuous document from a first supply roll toward said first printing zone, wherein said first continuous document has a first transverse width;

a second motor roller for feeding a second continuous document from a second supply roll toward said second printing zone, wherein said second continuous document has a second transverse width and wherein said first and second motor rollers are rotatably mounted on said frame and are disposed coaxial and adjacent therebetween;

first guide means for guiding said first and second continuous documents from said first and second motor rollers to said first and second printing zones along a substantially planar trajectory lying on a surface tangent to the platen, wherein said two documents have two adjacent edges between the first printing zone and the second printing zone and two external edges, and wherein said adjacent edges and said two external edges lay in said planar trajectory;

feeding means for feeding a discrete document between said platen and said printing head in correspondence with both said first printing zone and said second printing zone, wherein said feeding means comprises:

a motor shaft rotatably mounted on said frame parallel to said first and second motor rollers at a side of said planar trajectory including said platen, wherein said motor shaft extends beyond the external edges of said first and second continuous documents;

three feeding rollers coaxially mounted on said motor shaft in two lateral positions beyond the external edges of said first and second documents along said trajectory and in a space between the adjacent edges of said first and second documents, wherein each feeding roller comprises a projecting portion projecting from said surface tangent to said platen and said first and second continuous documents in such a manner that said three feeding rollers do not interfere with said first and second continuous documents, a pair of levers pivotally mounted on said frame and disposed perpendicularly to said motor shaft, a pinch roller rotatably mounted on said pair of levers substantially parallel to said motor shaft, and spring means for constantly urging said pair of levers and said pinch roller toward the projecting portion of said feeding rollers, wherein said guide bar is mounted on said pair of levers parallel to said pinch roller in such a manner that, when said discrete document is inserted into the machine, it is engaged between said feeding rollers and said pinch rollers without interference with the first and second motor rollers, and said carriage and said printing head are spaced away from said platen by a distance equal to the thickness of the introduced discrete document; and optical means for detecting an edge of said discrete document, said optical means being disposed in correspondence with said space and said planar trajectory in such a manner that said optical means do not interfere with said first and second continuous documents.

2. A point of sale printer according to claim 1, wherein a third motor roller is provided for feeding said first continuous document from said platen toward a takeup roll, and wherein a cutter blade controlled by an electric motor is provided in proximity with said second printing zone for selectively cutting off said second continuous document after it has been printed by said printing head.

3. A point of sale printer according to claim 1, wherein said guide means comprise a plate tangent to said surface and a blade spring pressing weakly the first and the second continuous document against said plate, wherein second guide means are provided for guiding said discrete document toward and away from said printing head along a predetermined feeding path having a substantially vertical portion over-posed to said surface tangent to the platen and to said blade, wherein said feeding rollers and said pinch roller are disposed in correspondence with said substantially vertical portion of said feeding path below said platen, and wherein said optical means are disposed along said substantially vertical portion of said feeding path both above said platen and below said feeding rollers.

* * * * *